US009347697B2

(12) United States Patent
Kim et al.

(10) Patent No.: US 9,347,697 B2
(45) Date of Patent: May 24, 2016

(54) AIR CONDITIONER AND CONTROL METHOD THEREOF

(71) Applicant: LG ELECTRONICS INC., Seoul (KR)

(72) Inventors: Byeongsu Kim, Seoul (KR); Yonghee Jang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 237 days.

(21) Appl. No.: 13/773,777

(22) Filed: Feb. 22, 2013

(65) Prior Publication Data

US 2013/0219927 A1 Aug. 29, 2013

(30) Foreign Application Priority Data

Feb. 23, 2012 (KR) ..... 10-2012-0018354

(51) Int. Cl.

| | |
|---|---|
| ***F25B 5/00*** | (2006.01) |
| ***F25B 30/02*** | (2006.01) |
| ***F25B 45/00*** | (2006.01) |
| ***F25B 1/10*** | (2006.01) |
| ***F25B 13/00*** | (2006.01) |

(52) U.S. Cl.

CPC . *F25B 30/02* (2013.01); *F25B 1/10* (2013.01); *F25B 13/00* (2013.01); *F25B 45/00* (2013.01); *F25B 2313/02741* (2013.01); *F25B 2400/13* (2013.01); *F25B 2600/2509* (2013.01)

(58) Field of Classification Search

CPC . F25B 1/10; F25B 2400/13; F25B 2600/2509
See application file for complete search history.

(56) References Cited

U.S. PATENT DOCUMENTS

| | | | | |
|---|---|---|---|---|
| 6,122,924 | A * | 9/2000 | Lifson et al. | 62/192 |
| 6,237,351 | B1 * | 5/2001 | Itoh | B60H 1/00921 62/113 |
| 6,385,981 | B1 * | 5/2002 | Vaisman | 62/196.3 |
| 6,694,750 | B1 * | 2/2004 | Lifson et al. | 62/113 |
| 6,918,264 | B2 * | 7/2005 | Park | F25B 13/00 62/160 |

FOREIGN PATENT DOCUMENTS

| | | |
|---|---|---|
| EP | 0 972 942 | 1/2000 |
| EP | 1 669 694 | 6/2006 |

OTHER PUBLICATIONS

European Search Report dated May 21, 2013.

* cited by examiner

*Primary Examiner* — Allen Flanigan
*Assistant Examiner* — Filip Zec
(74) *Attorney, Agent, or Firm* — Ked & Associates, LLP

(57) ABSTRACT

Provided is an air conditioner. The air conditioner including a compressor, an outdoor heat exchanger, an indoor heat exchanger, and an expansion device includes a supercooling device for supercooling a refrigerant condensed in the outdoor heat exchanger or the indoor heat exchanger, an injection passage through which the refrigerant passing through the supercooling device is introduced into an injection inflow part of the compressor, a bypass passage extending from the injection passage to a suction part of the compressor to bypass the refrigerant, and a passage opening/closing part disposed in at least one of the injection passage and the bypass passage to selectively block a flow of the refrigerant.

10 Claims, 7 Drawing Sheets

-Related Art-

AIR CONDITIONER AND CONTROL METHOD THEREOF

CROSS-REFERENCE TO RELATED APPLICATIONS

The present application claims priority under 35 U.S.C. 119 and 35 U.S.C. 365 to Korean Patent Application No. 10-2012-0018354 (filed on Feb. 23, 2012), which is hereby incorporated by reference in its entirety.

BACKGROUND

The present disclosure relates to an air conditioner and a control method thereof.

Air conditioners are home appliances that maintain indoor air into the most proper state according to use and purpose thereof. For example, such an air conditioner controls indoor air into a cold state in summer and controls indoor air into a warm state in winter. Furthermore, the air conditioner controls humidity of the indoor air and purifies the indoor air to become into a pleasant and clean state. In detail, the air conditioner has a refrigeration cycle in which compression, condensation, expansion, and evaporation processes for a refrigerant are performed. Thus, a cooling or heating operation of the air conditioner may be performed to cool or heat the indoor air according to the refrigeration cycle.

Such an air conditioner may be classified into a split type air conditioner in which indoor and outdoor units are separated from each other and an integral type air conditioner in which indoor and outdoor units are integrally coupled to each other as a single device, according to whether the indoor and outdoor units are separated from each other. The outdoor unit includes an outdoor heat exchanger heat-exchanging with external air, and the indoor unit includes an indoor heat exchanger heat-exchanging with indoor air. The air conditioner may be operated in a cooling mode or heating mode which are converted into each other.

When the air conditioner is operated in the cooling mode, the outdoor heat exchanger serves as a condenser, and the indoor heat exchanger serves as an evaporator. On the other hand, when the air conditioner is operated in the heating mode, the outdoor heat exchanger serves as an evaporator, and the indoor heat exchanger serves as a condenser.

FIG. 7 illustrates a pressure-enthalpy (p-h) diagram of a refrigerant cycle according to a related art. Referring to FIG. 7, a refrigerant is introduced into a compressor in a state "a", and then is compressed in the compressor and discharged in a state "b". Thereafter, the refrigerant is introduced into a condenser. The refrigerant in the state "b" may be in a liquid phase.

Then, the refrigerant is condensed in the condenser and discharged in a state "c". Thereafter, the refrigerant is throttled in an expansion device, and thus is changed into a state "d", i.e., a two-phase state. The refrigerant throttled in the expansion device is introduced into an evaporator. Then, the refrigerant is heat-exchanged in the evaporation, and thus is changed into the state "a". The refrigerant in the state "a" may be in a gaseous phase. Thus, the gaseous refrigerant is introduced into the compressor. The above-described refrigerant cycle is repeatedly performed.

According to the related art, cooling or heating performance may be limited.

In detail, when an external air condition is bad, that is, external air around an area on which the air conditioner is installed has a very high or low temperature, sufficient refrigerant circulation amount should be secured so as to obtain desired cooling/heating performance.

For this, a compressor having large capacity should be provided so as to increase performance of the compressor. In this case, there is a limitation that manufacturing or installation costs of the air conditioner are increased.

In addition, when the refrigerant discharged from the condenser is in an overcooled state, that is, overcooling of the refrigerant is secured, even though evaporation performance of the evaporator, i.e., a lower area of a line connecting a point "d" to a point "a" may be increased, it may be difficult to secure the overcooling of the refrigerant in a system of FIG. 6. Thus, it may be difficult to expect performance improvement.

SUMMARY

Embodiments provide an air conditioner which can adjust a flow rate of a refrigerant injected into a compressor according to a cooling or heating operation.

In one embodiment, an air conditioner including a compressor, an outdoor heat exchanger, an indoor heat exchanger, and an expansion device includes: a supercooling device for supercooling a refrigerant condensed in the outdoor heat exchanger or the indoor heat exchanger; an injection passage through which the refrigerant passing through the supercooling device is introduced into an injection inflow part of the compressor; a bypass passage extending from the injection passage to a suction part of the compressor to bypass the refrigerant; and a passage opening/closing part disposed in at least one of the injection passage and the bypass passage to selectively block a flow of the refrigerant.

In another embodiment, a method for controlling an air conditioner including a compressor, an outdoor heat exchanger, an indoor heat exchanger, and an expansion device includes: recognizing whether a cooling or heating operation of the air conditioner is performed; and when the air conditioner performs the heating operation, injecting a refrigerant into an injection inflow part of the compressor by closing a first passage opening/closing part and opening a second passage opening/closing part, and when the air conditioner performs the cooling operation, suctioning a refrigerant into a suction part of the compressor by opening the first passage opening/closing part and closing the second passage opening/closing part.

The details of one or more embodiments are set forth in the accompanying drawings and the description below. Other features will be apparent from the description and drawings, and from the claims.

DETAILED DESCRIPTION OF THE EMBODIMENTS

Hereinafter, an air conditioner according to embodiments will be described in detail with reference to the accompanying drawings.

Figure 1:
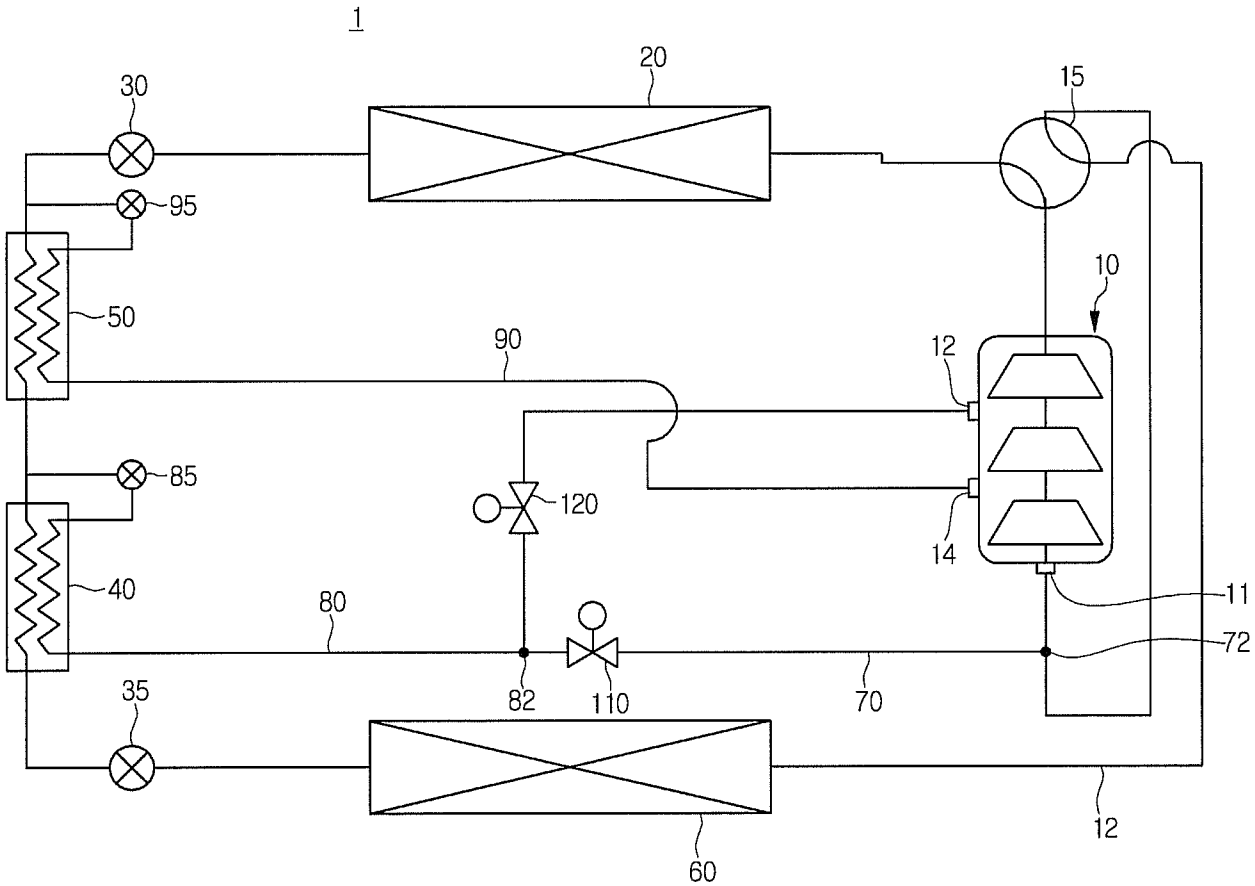
FIG. 1 is a system view of an air conditioner according to an embodiment.

FIG. 1 is a system view illustrating an air conditioner according to an embodiment.

Referring to FIG. 1, an air conditioner 1 according to an embodiment has a refrigeration cycle in which a refrigerant is circulated. The air conditioner 1 may perform a cooling or heating operation according to a circulation direction of the refrigerant.

The air conditioner 1 includes a compressor 10 for compressing a refrigerant, a passage switch part 15 for switching a flow direction of the refrigerant discharged from the compressor 10 according to a cooling or heating operation, an outdoor heat exchanger 20 or an indoor heat exchanger 60 for condensing the refrigerant compressed in the compressor 10, first and second expansion devices 30 and 35 disposed between the outdoor heat exchanger 20 and the indoor heat exchanger 60 to selectively expand the refrigerant, and a refrigerant tube 12 connecting the above-described parts to each other and guiding a flow of the refrigerant.

When the air conditioner 1 performs a cooling operation, the refrigerant is compressed in the compressor 10. Then, the refrigerant passes through the passage switch part 15 and is condensed in the outdoor heat exchanger 20. Thereafter, the refrigerant is expanded in the second expansion device 35, and then is evaporated in the indoor heat exchanger 60.

On the other hand, when the air conditioner 1 performs a heating operation, the refrigerant is compressed in the compressor 10. Then, the refrigerant passes through the passage switch part 15 and is condensed in the indoor heat exchanger 60. Thereafter, the refrigerant is expanded in the first expansion device 30, and then is evaporated in the outdoor heat exchanger 20.

That is, when the air conditioner 1 performs the cooling operation, the outdoor heat exchanger 20 serves as a condenser, and the indoor heat exchanger 60 serves as an evaporator. Also, when the air conditioner 1 performs the heating operation, the indoor heat exchanger 60 serves as a condenser, and the outdoor heat exchanger 20 serves as an evaporator.

Hereinafter, a configuration of a system when the air conditioner 1 performs the cooling operation will be described as an example.

The compressor 10 may be configured to perform multi-stage compression. For example, the compressor 10 may be a scroll compressor in which a refrigerant is compressed by a relative phase difference between a fixed scroll and an orbiting scroll.

The air conditioner 1 includes a plurality of supercooling devices 40 and 50 for supercooling the refrigerant passing through the condenser. For example, when the air conditioner performs the cooling operation, the plurality of supercooling devices 40 and 50 include a second supercooling device 50 for supercooling a refrigerant passing through the outdoor heat exchanger 20 and a first supercooling device 40 for supercooling a refrigerant passing through the second supercooling device 50.

The air conditioner 1 includes a second injection passage 90 for bypassing at least one portion of the refrigerant passing through the outdoor heat exchanger 20 and a second injection expansion part 95 disposed in the second injection passage 90 to adjust an amount of bypassed refrigerant. The refrigerant may be expanded while passing through the second injection expansion part 95.

A refrigerant bypassed into the second injection passage 90 of the refrigerant passing through the outdoor heat exchanger 20 may be called a "first branch refrigerant", and the rest of refrigerant except for the first branch refrigerant may be called a "main refrigerant". The main refrigerant and the first branch refrigerant are heat-exchanged with each other in the second supercooling device 50.

Since the first branch refrigerant is changed into a low-temperature low-pressure refrigerant while passing through the second injection expansion part 95, the first branch refrigerant absorbs heat while being heat-exchanged with the main refrigerant. Here, the main refrigerant releases heat into the first branch refrigerant. Thus, the main refrigerant may be supercooled. Also, the first branch refrigerant passing through the second supercooling device 50 is introduced (injected) into the compressor 10 through the second injection passage 90.

The compressor 10 includes a second injection inflow part 14 connected to the second injection passage 90. The second injection inflow part 14 is disposed on a first position of the compressor 10.

The air conditioner 1 includes a first injection passage 80 for bypassing at least one portion of the refrigerant passing through the second supercooling device 50 and a first injection expansion part 85 disposed in the first injection passage 80 to adjust an amount of bypassed refrigerant. The refrigerant may be expanded while passing through the first injection expansion part 85.

The refrigerant bypassed into the first injection passage 80 may be called a "second branch refrigerant". The main refrigerant and the second branch refrigerant are heat-exchanged with each other in the first supercooling device 40.

Since the second branch refrigerant is changed into a low-temperature low-pressure refrigerant while passing through the first injection expansion part 85, the second branch refrigerant absorbs heat while being heat-exchanged with the main refrigerant. Here, the main refrigerant releases heat into the second branch refrigerant. Thus, the main refrigerant may be supercooled. Also, the second branch refrigerant passing through the first supercooling device 40 is introduced (injected) into the compressor 10 through the first injection passage 80.

The compressor 10 includes a first injection inflow part 12 connected to the first injection passage 80. The first injection inflow part 12 is disposed on a second position of the compressor 10. That is, the first injection inflow part 12 and the second injection inflow part 14 may be connected to different positions of the compressor 10, respectively.

A bypass passage 70 for bypassing the refrigerant flowing into the first injection passage 80 toward an inlet side of the compressor 10 is connected to the first injection passage 80. In detail, a branch part 82 is disposed on one position of the first injection passage 80, and the bypass passage 70 extends from the branch part 82 toward the inlet side of the compressor 10.

A second passage opening/closing part 120 for selectively opening or closing the first injection passage 80 is provided in the first injection passage 80. Also, a first passage opening/closing part 110 for selectively opening or closing the bypass passage 70 is provided in the bypass passage 70. The second passage opening/closing part 120 is disposed between the branch part 82 and the first injection inflow part 12. The first passage opening/closing part 110 is disposed between the branch part 82 and a suction part 11 of the compressor 10.

According to an open state of the first passage opening/closing part 10 and the second passage opening/closing part 120, a refrigerant flowing into the first injection passage 80 may be injected from the first injection inflow part 12 into the compressor 10 via the second passage opening/closing part 120 or may be suctioned from the suction part 11 into the compressor 10 via the first passage opening/closing part 110.

A main refrigerant passing through the first supercooling device 40 is expanded while passing through the second expansion device 35 and then is introduced into the indoor heat exchanger 60.

The above-described flow direction of the refrigerant may be described on the basis of the cooling operation. On the other hand, when the heating operation is performed, the refrigerant may reversely flow. Hereinafter, when the air conditioner 1 performs the heating or cooling operation, a refrigerant flow and a pressure-enthalpy (P-H) diagram will be described.

Figure 2:
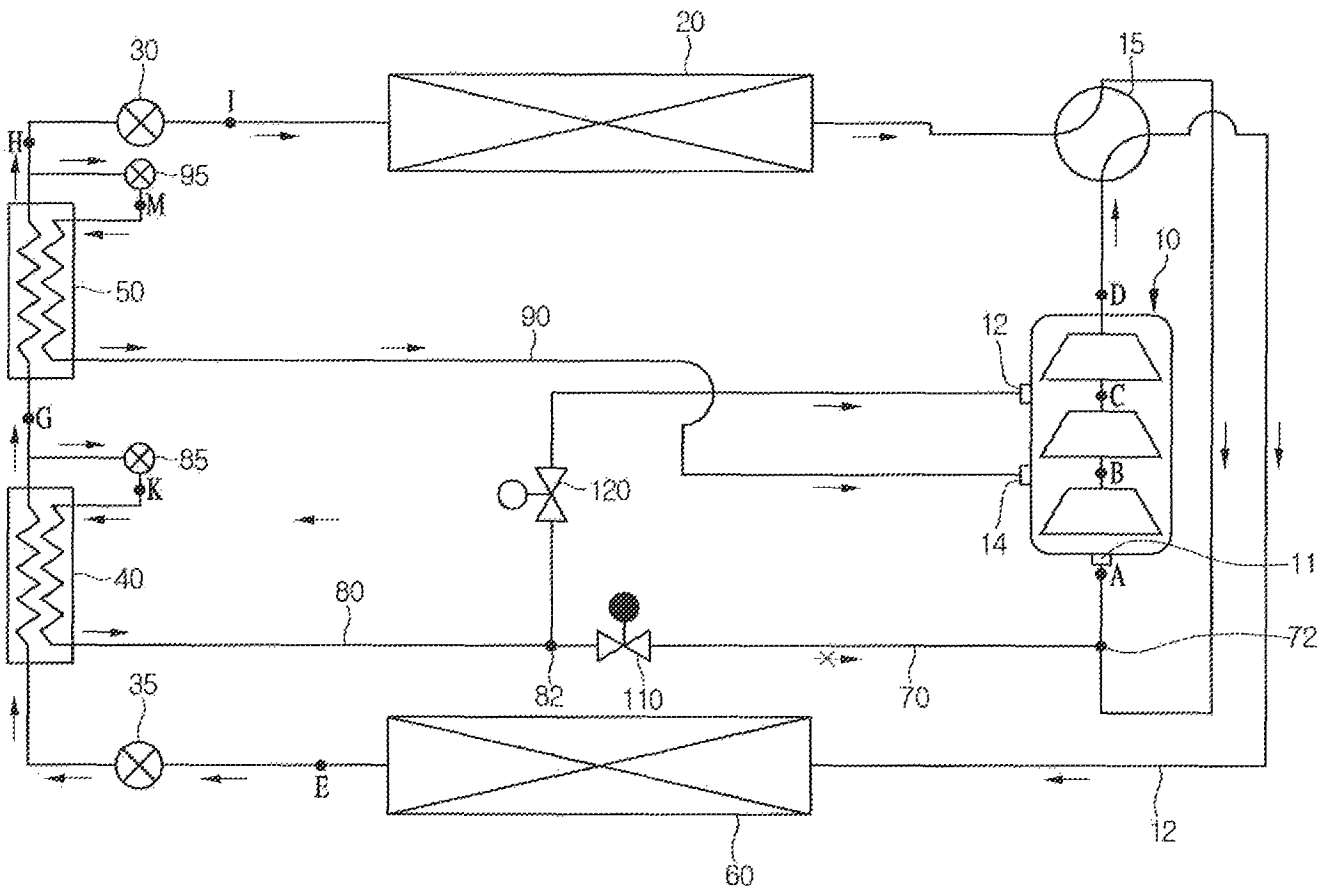
FIG. 2 is a system view illustrating a flow of a refrigerant in a heating operation of the air conditioner according to an embodiment.
Figure 3:
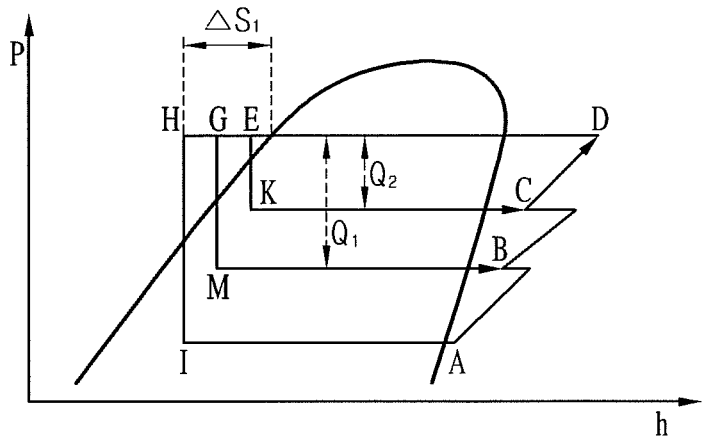
FIG. 3 is a pressure-enthalpy (P-H) diagram illustrating a property change of the refrigerant when the heating operation of FIG. 2 is performed.

FIG. 2 is a system view illustrating a flow of a refrigerant in the heating operation of the air conditioner according to an embodiment. FIG. 3 is a P-H diagram illustrating a property change of the refrigerant when the heating operation of FIG. 2 is performed.

Referring to FIGS. 2 and 3, when the air conditioner 1 performs the heating operation, a refrigerant (a state A) suctioned into the compressor 10 through the suction part 11 is compressed and then mixed with a refrigerant injected into the compressor 10 through the second injection passage 90. The mixed refrigerant is in a state B. A process in which the refrigerant is compressed from the state A into the state B is called a "first stage compression".

The refrigerant (the state B) is compressed again, and then the compressed refrigerant is mixed with a refrigerant injected into the compressor 10 through the first injection passage 80. The mixed refrigerant is in a state C. A process in which the refrigerant is compressed from the state B into the state C is called a "second stage compression".

The refrigerant (the state C) is compressed again, and then is in a state D. As described above, when the heating operation is performed, the injection process is performed two times, and the compression process is performed three times. The refrigerant having the state D is introduced into the indoor heat exchanger 60 through the passage switch part 15. The refrigerant condensed in the indoor heat exchanger 20 is in a state E.

The refrigerant passing through the indoor heat exchanger 60 passes through the first supercooling device 40. Also, a portion of the refrigerant (the first branch refrigerant) is bypassed and expanded in the first injection expansion part 85. The refrigerant expanded in the first injection expansion part 85 is in a state K and is heat-exchanged with the main refrigerant having a state E. In this process, the main refrigerant having the state E is supercooled into a state G. Also, the first branch refrigerant having a state K is injected into the compressor 10 through the first injection inflow part 12, and then is mixed with the refrigerant within the compressor 10 to become in the state C.

Here, the second passage opening/closing part 120 is opened, and the first passage opening/closing part 110 is closed. Thus, the refrigerant flowing into the first injection passage 80 may pass through the second passage opening/closing part 120 and then be injected into the compressor 10.

The main refrigerant (the state G) passing through the first supercooling device 40 passes through the second supercooling device 50. Also, a portion of the refrigerant (the second branch refrigerant) is bypassed and is expanded in the second injection expansion part 95. The refrigerant expanded in the second injection expansion part 95 is in a state M and is heat-exchanged with the main refrigerant having the state G. In this state, the main refrigerant having the state G is supercooled into a state H. Also, the second branch refrigerant having the state M is injected into the compressor 10 through the second injection inflow part 14, and then is mixed with the refrigerant within the compressor 10 to become in the state B.

The main refrigerant supercooled into the state H is expanded in the first expansion device 30 and then is evaporated in the outdoor heat exchanger 20. Then, the refrigerant is introduced into the compressor 10.

As described above, when the air conditioner 1 performs the heating operation, since the refrigerant passing through the plurality of supercooling devices 40 and 50 is injected two times into the compressor, an amount of refrigerant circulating into the refrigeration system may be increased. Also, since the refrigerant condensed in the indoor heat exchanger 60 is supercooled into the state H (a supercooling degree $\Delta S1$), heating performance of the system may be improved.

A pressure of a diagram connecting a point D to a point H may be called a "high pressure", and a pressure of a diagram (high-pressure side injection) connecting a point C to a point K, i.e., a pressure in the first injection passage 80 may be called a "first middle pressure". Also, a pressure of a diagram (low-pressure side injection) connecting a point B to a point M, i.e., a pressure in the second injection passage 90 may be called a "second middle pressure", and a pressure of a diagram connecting a point A to a point I may be called a "low pressure".

Here, a flow rate Q1 of the refrigerant injected into the compressor 10 through the second injection passage 90 may be proportional to a pressure difference between the high pressure and the second middle pressure. Also, a flow rate Q2 of the refrigerant injected into the compressor 10 through the first injection passage 80 may be proportional to a pressure difference between the high pressure and the first middle pressure.

Thus, the more the first and second middle pressures are defined toward the low pressure, the more the flow rate of refrigerant injected into the compressor 10 is increased. As a result, when an external air condition required for the heating operation, i.e., an external air temperature is low, an evaporation pressure (low pressure) of the refrigeration system is low. Thus, the first middle pressure and the second middle pressure may be defined within a reasonable range, and the injection effects of the refrigerant may be sufficiently achieved.

Figure 4:
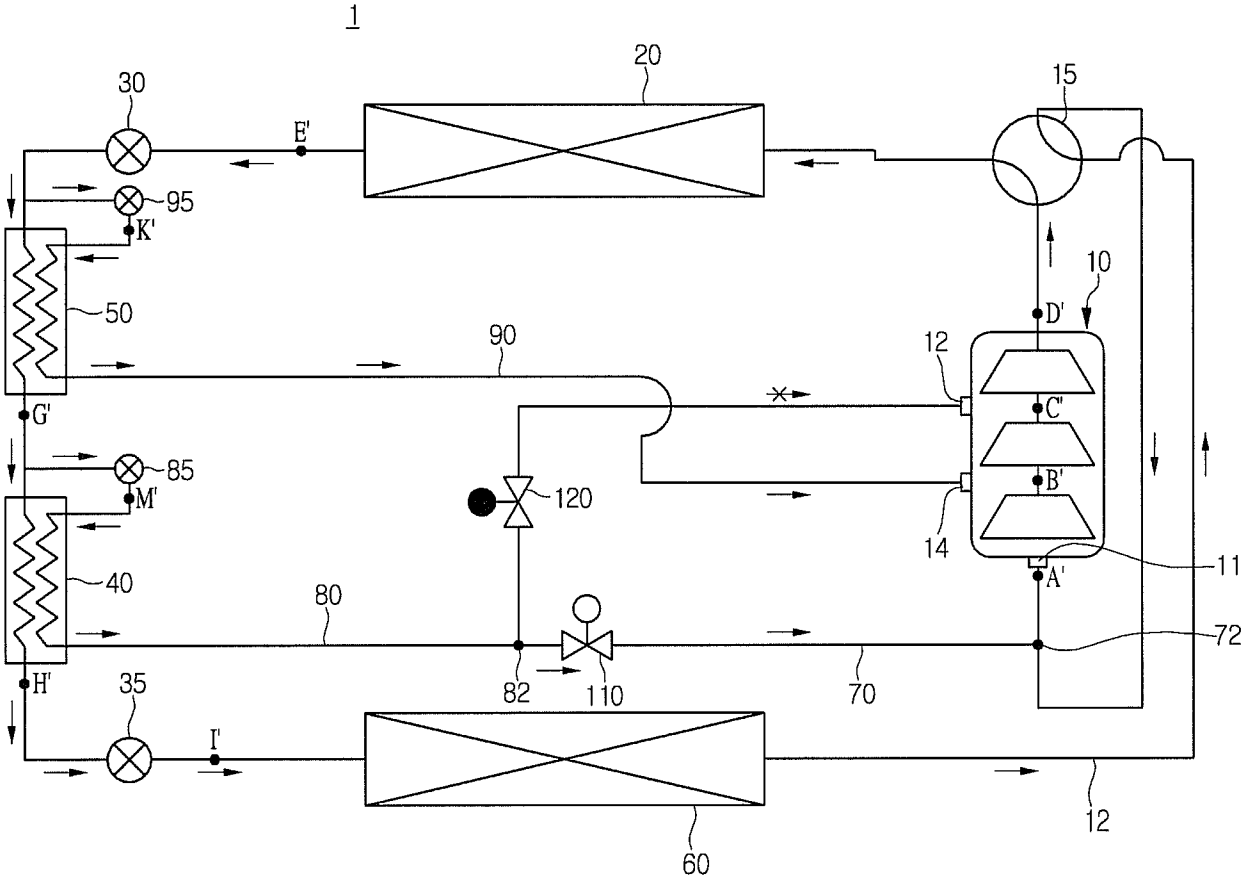
FIG. 4 is a system view illustrating a flow of a refrigerant in a cooling operation of the air conditioner according to an embodiment.
Figure 5:
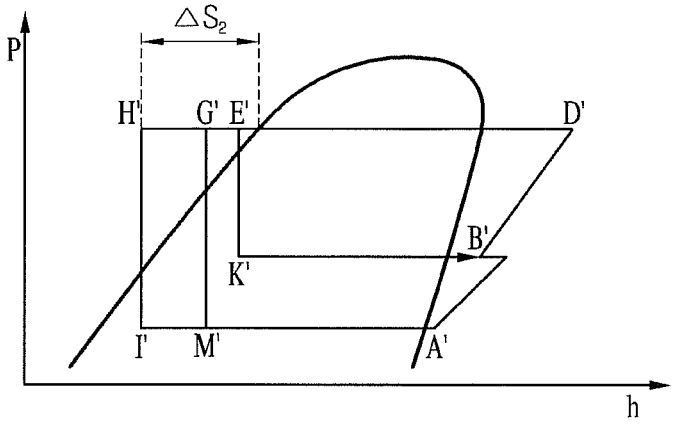
FIG. 5 is a P-H diagram illustrating a property change of the refrigerant when the cooling operation of FIG. 4 is performed.

FIG. 4 is a system view illustrating a flow of a refrigerant in a cooling operation of the air conditioner according to an embodiment. FIG. 5 is a P-H diagram illustrating a property change of the refrigerant when the cooling operation of FIG. 4 is performed.

Referring to FIGS. 4 and 5, when the air conditioner 1 performs a cooling operation, a refrigerant (a state A') suctioned into the compressor 10 through the suction part 11 is compressed and then mixed with a refrigerant injected into the compressor 10 through the second injection passage 90. The mixed refrigerant is in a state B. A process in which the refrigerant is compressed from the state A' into a state B' is called a "first stage compression".

The refrigerant (the state B') is compressed again to become in a state D'. A process in which the refrigerant is compressed from the state B' into the state D' is called a "second stage compression". Here, the injection of a refrigerant flowing into the first bypass passage 80 into the compressor 10 may be restricted.

The refrigerant having the state D' is introduced into the outdoor heat exchanger 20 through the passage switch part 15, and a refrigerant condensed in the outdoor heat exchanger 20 is in a state E'.

The refrigerant passing through the outdoor heat exchanger 20 passes through the second supercooling device 50. Also, a portion of the refrigerant (the first branch refrigerant) is bypassed and expanded in the second injection expansion part 95. The refrigerant expanded in the second injection expansion part 95 is in a state K' and is heat-exchanged with a main refrigerant having a state E'. In this process, the main refrigerant having the state E' is supercooled into a state G'. A first branch refrigerant having a state K' is injected into the compressor 10 through the second injection inflow part 14, and then is mixed with the refrigerant within the compressor 10 to become in the state B'.

The main refrigerant (the state G') passing through the second supercooling device 50 passes through the first supercooling device 40. Also, a portion of the refrigerant (the second branch refrigerant) is bypassed and is expanded in the first injection expansion part 85. The refrigerant expanded in the first injection expansion part 85 is in a state M' and is heat-exchanged with the main refrigerant having the state G'. In this process, the main refrigerant having the state G' is supercooled into a state H' Also, the second branch refrigerant having the state M' is injected into the suction part 11 of the compressor 10 through the bypass passage 70.

Here, the second passage opening/closing part 120 is closed, and the first passage opening/closing part 110 is opened. Thus, the refrigerant flowing into the first injection passage 80 may pass through the first passage opening/closing part 110 and then be suctioned into the compressor 10. That is, the injection of the refrigerant into the high pressure side may be restricted, and the refrigerant may be suctioned into the compressor 10 to more secure the supercooling degree.

In summary, since the refrigerant having the state M' is introduced into the compressor 10, a pressure of the refrigerant having the state M' may correspond to a low pressure (a diagram I-A pressure in FIG. 3). Thus, the first injection expansion part 85 may be adjusted in open degree so that the refrigerant is expanded to a pressure lower than that of the refrigerant having the state M of FIG. 3.

Also, a state (H') of the main refrigerant after being heat-exchanged with the refrigerant having the state M' may be secured in supercooling degree when compared to that of the state H of the refrigerant in FIG. 3. That is, a supercooling degree (ΔS2) in FIG. 5 may be greater than that (ΔS1) in FIG. 3.

The main refrigerant supercooled into the state H' is expanded in the second expansion device 35 and then is evaporated in the indoor heat exchanger 60. Then, the refrigerant is introduced into the compressor 10. Here, the refrigerant passing through the indoor heat exchanger 60 is mixed with the refrigerant passing through the bypass passage 70 within a junction part 72, and then, the mixed refrigerant is introduced into the compressor 10.

As described above, when the air conditioner 1 performs the cooling operation, an evaporation pressure is increased due to a relatively high external temperature. As a result, the injection of the refrigerant into the compressor 10 several times may be restricted. Thus, the injection of the refrigerant into the high pressure side may be omitted, and the refrigerant may be directly suctioned to further secure the supercooling degree.

When the supercooling degree is increased in the cooling operation, heat-exchange efficiency of the system may be improved. Also, since the refrigerant introduced into the indoor heat exchanger has a liquid state or low quality, noises occurring in an indoor unit may be reduced.

Figure 6:
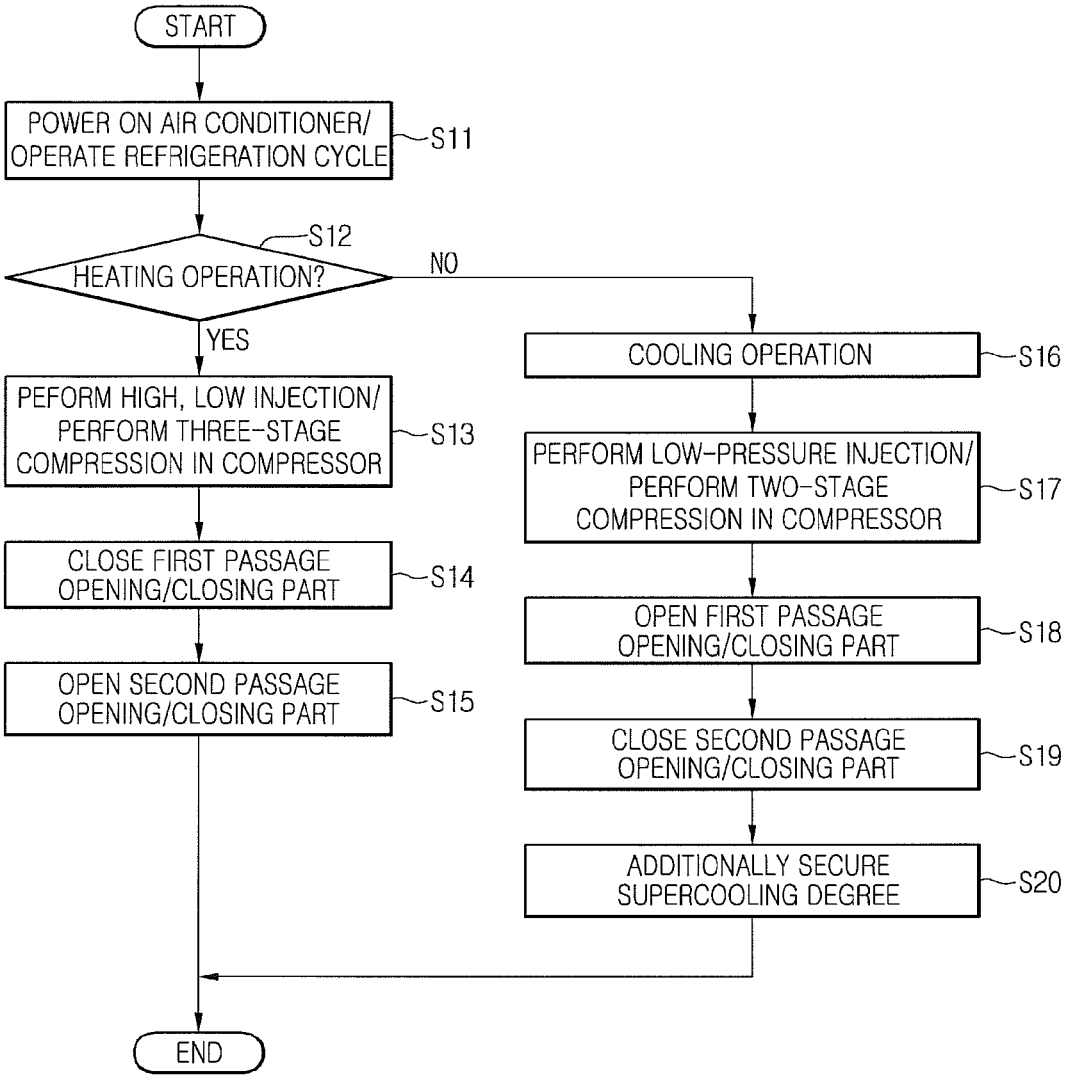
FIG. 6 is a flowchart illustrating a control method of the air conditioner according to an embodiment.
Figure 7:
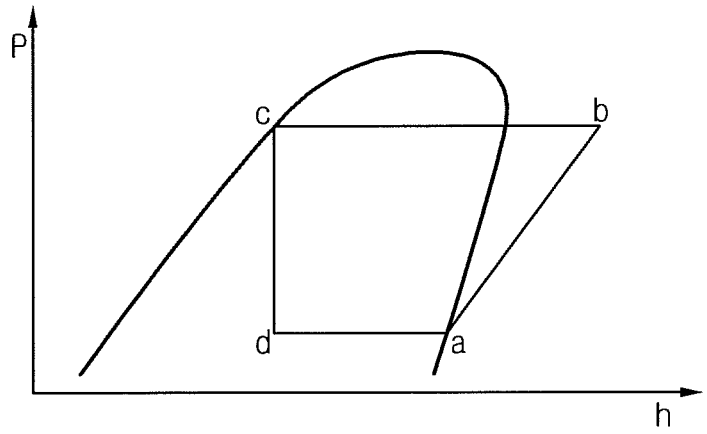
FIG. 7 is a P-H diagram illustrating a property change of a refrigerant depending on an operation of an air conditioner according to a related art.

FIG. 6 is a flowchart illustrating a control method of the air conditioner according to an embodiment. Referring to FIG. 6, a control method of the air conditioner according to an embodiment will be described.

When an air conditioner 1 is turned on to operate a refrigeration cycle in operation S11, it is recognized whether a cooling or heating operation is performed. For example, a user may manipulate a predetermined input unit to operate the cooling or heating operation. In operation S12, it may be determined whether the cooling or heating operation is performed according to an input content.

When the air conditioner 1 performs the heating operation, as shown in FIGS. 2 and 3, the injection (high and low pressure injection) may be performed two times, and the three stage compression may be performed in compressor 10 in operation S13.

In detail, the first passage opening/closing part 110 is closed, and the second passage opening/closing part 120 is opened. Thus, the refrigerant flowing into the first injection passage 80 flows from the branch part 82 toward the second injection inflow part 14. That is, the injection into the high pressure side may be performed, and thus, an amount of refrigerant circulating into the system may be increased in operations S14 and S15.

On the other hand, when the air conditioner 1 performs the cooling operation, as shown in FIGS. 4 and 5, the injection into the low pressure side and the two stage compression of the compressor 10 may be performed. That is, the injection into the high pressure side may be restricted in operations S16 and S17.

In detail, in operations S18 and S19, the first passage opening/closing part 110 is opened, and the second passage opening/closing part 120 is closed. Thus, the refrigerant flowing into the first injection passage 80 flows from the branch part 82 toward the suction part 11. That is, the injection of the refrigerant into the high pressure side may be restricted, and the supercooling degree of the refrigerant may be more secured to improve performance of the system in operation S20.

According to the embodiment, an amount of refrigerant injected into the compressor may be adjusted according to the operation mode of the air conditioner to perform efficient injection and secure adequate supercooling degree.

Specifically, when the heating operation is performed, an amount of refrigerant circulating through the high-pressure injection and low-pressure injection may be increased in the compressor. Also, when the cooling operation is performed, the low-pressure injection may be performed to additionally secure the supercooling degree.

Also, the high-pressure injection may be selectively performed according to the cooling or heating operation, and the refrigerant passage may be easily varied by the passage opening/closing part according to whether the high-pressure injection is performed. Thus, the air conditioner may be effectively controlled according to the cooling or heating operation mode.

Also, since the refrigerant having the middle pressure may be injected into the compressor, a power required for compressing the refrigerant may be reduced in the compressor. Thus, the cooling or heating efficiency may be improved.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising a compressor, an outdoor heat exchanger, an indoor heat exchanger, and an expansion device, the air conditioner comprising:

at least one supercooling device that supercools a refrigerant condensed in the outdoor heat exchanger or the indoor heat exchanger;

at least one injection passage through which the refrigerant passing through the at least one supercooling device is introduced into an injection inflow port of the compressor;

a bypass passage that extends from the at least one injection passage to a suction port of the compressor to bypass the refrigerant;

a branch provided at the at least one injection passage to guide the refrigerant from the at least one injection passage to the bypass passage; and at least one valve disposed in at least one of the at least one infection passage or the bypass passage to selectively block a flow of the refrigerant, wherein the at least one valve comprises a first valve disposed in the bypass passage to selectively restrict suction of the refrigerant into the suction port and a second valve disposed in the at least one injection passage to selectively restrict injection of the refrigerant into the injection inflow port, wherein the second valve is disposed between the branch and the injection inflow port of the compressor and the first valve is disposed between the branch and the suction port of the compressor, and wherein in a first operation mode, the first valve is opened and the second valve is closed such that the refrigerant flows from the at least one supercooling device into the bypass passage from the at least one injection passage and is introduced into the suction port, and in a second operation mode, the first valve is closed and the second valve is opened such that the refrigerant flows into the injection inflow port through the at least one injection passage.

2. The air conditioner according to claim 1, wherein the at least one supercool device comprises first and second supercooling devices disposed between the outdoor heat exchanger and the indoor heat exchanger.

3. The air conditioner according to claim 2, wherein the first operation mode comprises a cooling operation, and wherein one-stage compressed refrigerant introduced into the suction port of the compressor is mixed with a refrigerant injected from the second supercooling device and is compressed in two stages in the compressor when the air conditioner performs the cooling operation.

4. The air conditioner according to claim 2, wherein the second operation mode comprises a heating operation, and wherein when the air conditioner performs the heating operation, one-stage compressed refrigerant introduced into the suction port of the compressor is mixed with a refrigerant injection from the second supercooling device and is compressed in two stages in the compressor, and the two-stage compressed refrigerant is mixed with a refrigerant injected from the first supercooling device and is compressed in three stages.

5. The air conditioner according to claim 2, wherein the at least one injection passage comprises:

a first injection passage through which a refrigerant passing through the first supercooling device is injected into a high-pressure side of the compressor; and a second injection passage through which a refrigerant passing through the second supercooling device is injected into a low-pressure side of the compressor.

6. The air conditioner according to claim 1, wherein the first operation mode is a cooling operation mode, and the second operation mode is a heating operation mode.

7. The air conditioner according to claim 1, further comprising a passage switch that alternates a flow direction of the refrigerant based on whether the first operation mode or the second operation mode is being performed.

8. The air conditioner according to claim 1, wherein the expansion device further comprises a first expansion device adjacent to the outdoor heat exchanger, and a second expansion valve adjacent to the indoor heat exchanger.

9. A method for controlling an air conditioner, the air conditioner comprising a compressor, an outdoor heat exchanger, an indoor heat exchanger, an expansion device, at least one supercooling device that supercools a refrigerant condensed in the outdoor heat exchanger or the indoor heat exchanger, at least one injection passage that extends from the at least one supercooling device to an injection inflow port of the compressor, and a bypass passage that extends from the at least one injection passage to a suction port of the compressor, the method comprising:

recognizing whether a cooling or heating operation of the air conditioner is performed; and injecting a refrigerant discharged from the at least one supercooling device into the injection inflow port of the compressor by closing a first valve installed in the bypass passage and opening a second valve installed in the at least one injection passage when the air conditioner performs the heating operation, and suctioning a refrigerant discharged from the at least one supercooling device into the suction port of the compressor by opening the first valve and closing the second valve when the air conditioner performs the cooling operation.

10. The method according to claim 9, wherein the refrigerant is compressed in two stages in the compressor when the air conditioner performs the cooling operation, and the refrigerant is compressed, into three stages in the compressor when the air conditioner performs the heating operation.

* * * * *